United States Patent [19]

Healy

[11] 4,339,269

[45] Jul. 13, 1982

[54] PROCESS FOR SINTERING LEAD CONCENTRATES

[75] Inventor: George W. Healy, Sandy, Utah

[73] Assignee: University of Utah, Salt Lake City, Utah

[21] Appl. No.: 183,660

[22] Filed: Sep. 2, 1980

[51] Int. Cl.[3] ..... C22B 1/20

[52] U.S. Cl. ..... 75/5; 75/8; 423/89

[58] Field of Search ..... 75/3–9, 75/116; 423/47, 48, 89

[56] References Cited

U.S. PATENT DOCUMENTS

| | | | |
|---|---|---|---|
| 2,498,766 | 2/1950 | Pettigrew | 75/5 |
| 2,789,034 | 4/1957 | Swaine et al. | 75/5 |
| 2,850,371 | 9/1958 | Brooks et al. | 75/5 |
| 4,144,051 | 3/1979 | Rahn et al. | 75/9 |
| 4,266,967 | 5/1981 | Yamada et al. | 75/5 |

FOREIGN PATENT DOCUMENTS

| | | | |
|---|---|---|---|
| 50-4180 | 2/1975 | Japan | 75/5 |
| 55-47329 | 4/1980 | Japan | 75/5 |
| 852719 | 10/1960 | United Kingdom | 75/5 |
| 881634 | 11/1961 | United Kingdom | 75/5 |
| 1106813 | 3/1968 | United Kingdom | 75/5 |

*Primary Examiner*—Michael L. Lewis

*Attorney, Agent, or Firm*—H. Ross Workman; J. Winslow Young; Allen R. Jensen

[57] ABSTRACT

An improved process for increasing (1) the removal of sulfur from lead concentrates and (2) the ratio of fresh, lead concentrate in the feed to a conventional lead concentrate sintering machine. Oxygen is added to the air of the updraft ignition section in predetermined amounts coupled with predetermined reductions and finally, termination of oxygen enrichment at a predetermined distance from the point of downdraft ignition. Additional cooling is supplied by use of finely dispersed, liquid water introduced into preselected wind boxes at predetermined positions downstream of the termination of oxygen enrichment.

13 Claims, 4 Drawing Figures

PROCESS FOR SINTERING LEAD CONCENTRATES

This invention was produced during the course of work under a contract with the U.S. Bureau of Mines, contract no. GO 264,027.

BACKGROUND

1. Field of the Invention

This invention relates to the sintering of lead concentrates and, more particularly, to an improved process for sintering lead concentrates using programmed oxygen enrichment coupled with the use of fog nozzles in selected wind boxes to obtain the highest permissible sintering temperatures for increased production while achieving a relatively high degree of desulfurization.

2. The Prior Art

For the past several decades, the pyrometallurgical production of lead from lead sulfide concentrates has been accomplished by (1) the autogenous updraft sintering of the lead sulfide concentrates for sulfur removal followed by (2) blast furnace smelting of the sinter using coke as the fuel. With particular reference to the schematic illustration of a conventional sintering process shown in FIG. 1, the sintering operation takes place in a conventional sintering machine wherein an initial, thin layer (about 30 millimeters) of balled mix (having a ratio of about 137 kg concentrates, 76 kg recycle slag, and 263 kg return sinter) is laid on the moving grate of the sinter machine. The grate is continuous and moves to the right at a rate of about 1 meter per minute. This initial layer is heated to ignition temperature by downwardly fired oil or gas burners. The combustion gases from the burners are drawn downwardly through the layer and removed.

Immediately following the ignition position, the remainder of the mix bed is spread on top of the ignition layer to a total height of about 280 millimeters. Air is blown upwardly through both the hot, ignition layer and the overlying fresh mix. Heat from the hot, ignition layer is sufficient to commence ignition of the adjacent material with the resulting hot combustion gases passing upwardly through the balance of the fresh mix. The upwardly moving, hot gases, depleted in oxygen, rise from the ignition zone to enter the balance of the fresh mix, preheating and drying the same. As the bed moves to the right, the region of ignition forms a reaction band that moves upwardly through the bed resulting in a band of reacting material located generally diagonally through the moving bed. The thickness of the reacting band depends upon the reaction rate. At a point a few minutes after ignition, air rising upwardly through the grate is heated as it passes through the reacted sinter and cools the same prior to entering partially reacted mix and fresh mix to react therewith, passing thence into additional unreacted material which is dried and preheated by the reaction gases.

The gas issuing from the top of the bed contains oxides of sulfur and is collected and sent to the acid plant where the sulfur oxides are converted into sulfuric acid. Approximately 84 percent of the sulfur is removed by this conventional sintering process.

Great care must be taken to prevent excessive temperature rise in the sintering process since temperatures above about 1300 K. result in the production of excessive amounts of liquid oxides which plug the interstices and impede the passage of oxidizing gases. Importantly, the initial composition of the charge to the sintering machine is carefully predetermined in order to control the temperature that is reached in the sintering process. For example, the relatively high ratio of cooled, return sinter (263 kg) assures that the richness of the charge will be sufficiently diluted to maintain temperatures below the 1300 K. limit. The cooled sinter also (1) provides the necessary porosity for the mix and (2) acts as a heat sink. The recycled slag (76 kg) serves as a flux for the process.

It would, therefore, be an advancement in the art to provide improvements in the process for sintering lead concentrates. It would also be an advancement in the art to increase the percentage of sulfur removed from the sinter. Another advancement in the art would be to provide improvements in the process for sintering lead concentrates at an increased rate of production. Such a novel, improved process is disclosed and claimed herein.

BRIEF SUMMARY AND OBJECTS OF THE INVENTION

The present invention relates to novel improvements in the sintering process for increasing sulfur elimination to about 95 percent. The conventional sintering process is improved by the carefully controlled use of oxygen enrichment at a rate to avoid excessive temperature rise while preventing overheating by adding atomized water to certain of the wind boxes beneath the grate of the sintering machine when temperatures will otherwise be too high. The improved process thereby accommodates an increased rate of production, the increased rate of production tending to offset the additional cost of the oxygen needed to maximize sulfur removal from the sinter.

It is, therefore, a primary object of this invention to provide improvements in the process for removing sulfur from lead concentrates.

Another object of this invention is to provide an improved process for sintering lead concentrates and removing sulfur therefrom by the carefully programmed addition of oxygen.

Another object of this invention is to provide an improved process for preventing overheating of the sinter in a sintering machine by means of cooling with atomized water added to preselected wind boxes in the sintering machine.

These and other objects and features of the present invention will become more fully apparent from the following description and appended claims taken in conjunction with the accompanying drawing.

DETAILED DESCRIPTION OF THE PREFERRED EMBODIMENTS

Figure 1:
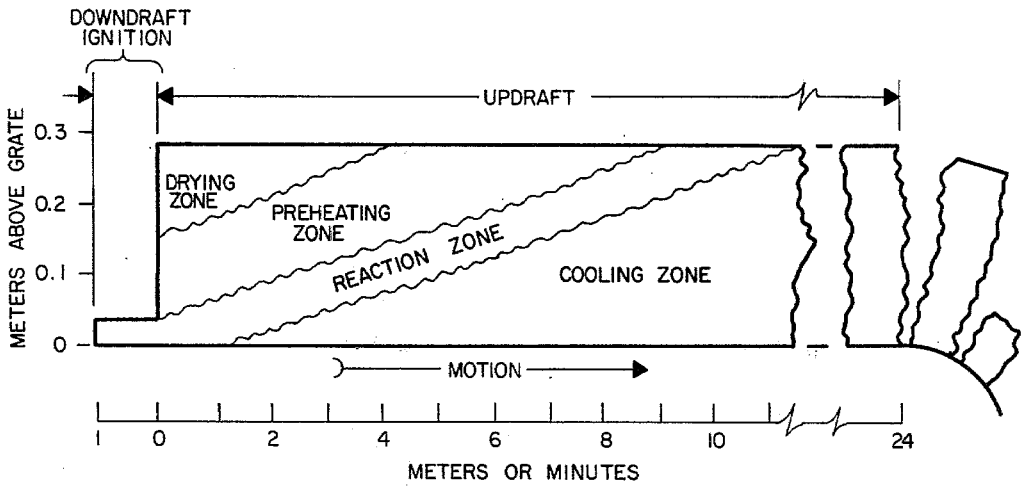
FIG. 1 is a schematic illustration of the operation of a conventional sintering machine.

The invention is best understood by reference to the drawing in combination with the following description.

General Discussion

Figure 2:
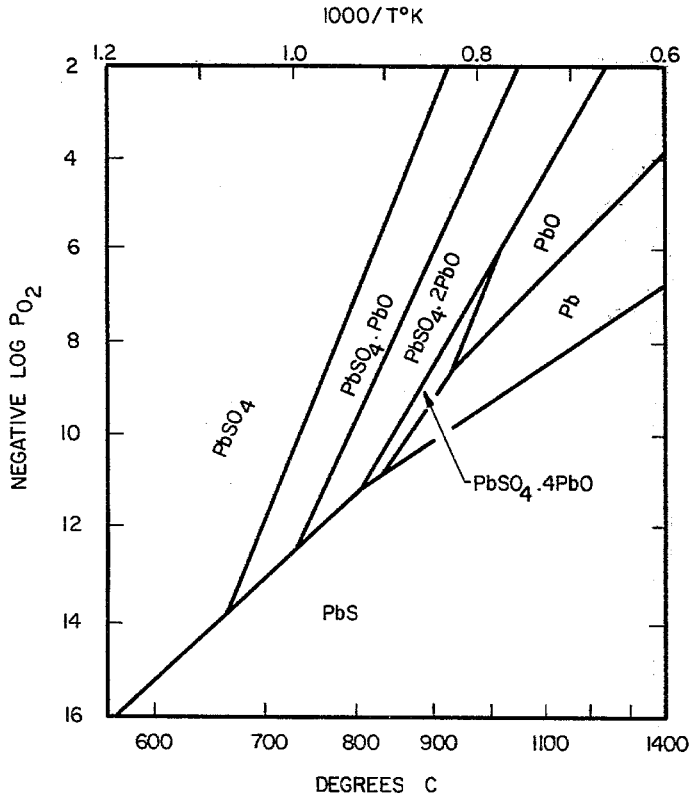
FIG. 2 is a graph illustrating the phase relations in the lead/sulfur/oxygen system when air is the oxidant.

Sulfur is present in lead sinter in two forms: as (a) sulfate, either $PbSO_4$ or basic sulfates $PbSO_4.nPbO$ where n is 1, 2, or 4, and as (b) unreacted sulfide. The oxidation of the lead sulfide at low temperatures leads to sulfate formation; at intermediate temperatures to basic sulfates; and at high temperatures to lead oxide or metallic lead. This temperature/composition relationship is shown more fully in FIG. 2 wherein it is assumed that the sulfur dioxide pressure approximates 0.2 atmospheres and air is used as the oxidant. Referring particularly to FIG. 2, if a particle of lead sulfide, PbS, is exposed to an oxidizing atmosphere, the products formed will be found by following the upper boundary of the field that is labeled PbS. Thus, for temperatures below about 670° C., the product formed is lead sulfate, $PbSO_4$, and no sulfur is removed. Between 670° and 730° C., half of the sulfur in PbS is eliminated, forming $PbSO_4.PbO$. From 730° to 800° C., two-thirds of the sulfur is removed forming $PbSO_4.2PbO$. Between 800° and 830° C., four-fifths, of the sulfur is eliminated with the most basic sulfate, $PbSO_4.4PbO$ being the product. Above 830° C., metallic lead is the equilibrium product, but the oxygen content in equilibrium with it is practically zero, meaning that any excess oxygen will result in PbO being formed as a secondary reaction product above 920° C. where Pb and PbO are in equilibrium. Thus, metallic lead is only found occasionally in lead sinter where there is a slight deficiency in the stoichiometric oxygen supplied for reaction with PbS.

From the foregoing, it is clear that the proportion of the sulfur in the concentrate that is removed depends upon the temperature reached where the sulfide and the oxidant come in contact. One technique for modifying the temperature locally in a section of the sinter strand would be the use of carefully controlled, predetermined oxygen enrichment at different levels in the wind boxes. Advantageously, it was discovered that even the addition of 100 percent oxygen following ignition with air (21 percent oxygen) did not result in excessive temperatures in the first wind boxes.

With reference to Table I, a comparison was made of the best use of a limited amount of commercially pure oxygen to enrich the air in the wind boxes of each succeeding section of the sintering machine downstream of the ignition section. The conclusion obtained from the foregoing is that it is definitely better to enrich the section immediately following the ignition section. However, splitting the oxygen amongst the two sections following ignition seems to be an even greater improvement while the latter two options illustrated in Table I are not as good, although showing better desulfurization than use in the ignition batch alone.

TABLE I

BEST USE OF A LIMITED AMOUNT OF COMMERCIALLY PURE OXYGEN
Total amount of enrichment oxygen 0.025 kg per 100 kg of new Pb, distributed in several ways to sinter strand sections of 1.2 m

| Percent Oxygen by Volume in Wind to Each Section | | | | | | Overall Sulfur Removed Percent of Sulfide |
|---|---|---|---|---|---|---|
| Ignition | 1 | 2 | 3 | 4 | Balance | Charged |
| 100 | 21 | 21 | 21 | 21 | 21 | 87.6 |
| 21 | 100 | 21 | 21 | 21 | 21 | 89.7 |
| 21 | 34.7 | 34.7 | 21 | 21 | 21 | 91.5 |
| 21 | 28.5 | 28.5 | 28.5 | 21 | 21 | 89.1 |

TABLE I-continued

BEST USE OF A LIMITED AMOUNT OF COMMERCIALLY PURE OXYGEN
Total amount of enrichment oxygen 0.025 kg per 100 kg of new Pb, distributed in several ways to sinter strand sections of 1.2 m

| Percent Oxygen by Volume in Wind to Each Section | | | | | | Overall Sulfur Removed Percent of Sulfide |
|---|---|---|---|---|---|---|
| Ignition | 1 | 2 | 3 | 4 | Balance | Charged |
| 21 | 26.2 | 26.2 | 26.2 | 26.2 | 21 | 89.1 |

The principal effects of oxygen enrichment in the ignition section is that the enrichment increases the temperature of both the gas and the solid. However, the heat loss in the gas is decreased because the volume of gas is lower because of the decrease in its overall nitrogen content. As a consequence of increasing the ideal temperature (a) the fraction reacted is calculated to be higher, (b) the reaction rate is also assumed to be proportional to oxygen content, causing a further increase in fraction reacted. The overall effect is to decrease the remaining unreacted sulfide. However, this more complete reaction in the ignition zone is not necessarily an unmitigated blessing since it decreases the fuel supply to the next or updraft sections of the sinter strand.

Experimental runs were conducted using 70 percent oxygen initially following ignition at 21 percent oxygen and then judiciously decreasing the oxygen percentage so that temperatures of 1300 K. were not exceeded. If the temperature limitation of 1300 K. is accepted, maximum permissible enrichment would be approximately 60 percent beyond which so much melting would be likely to occur that porosity of the sinter strand would be lost.

Figure 3:
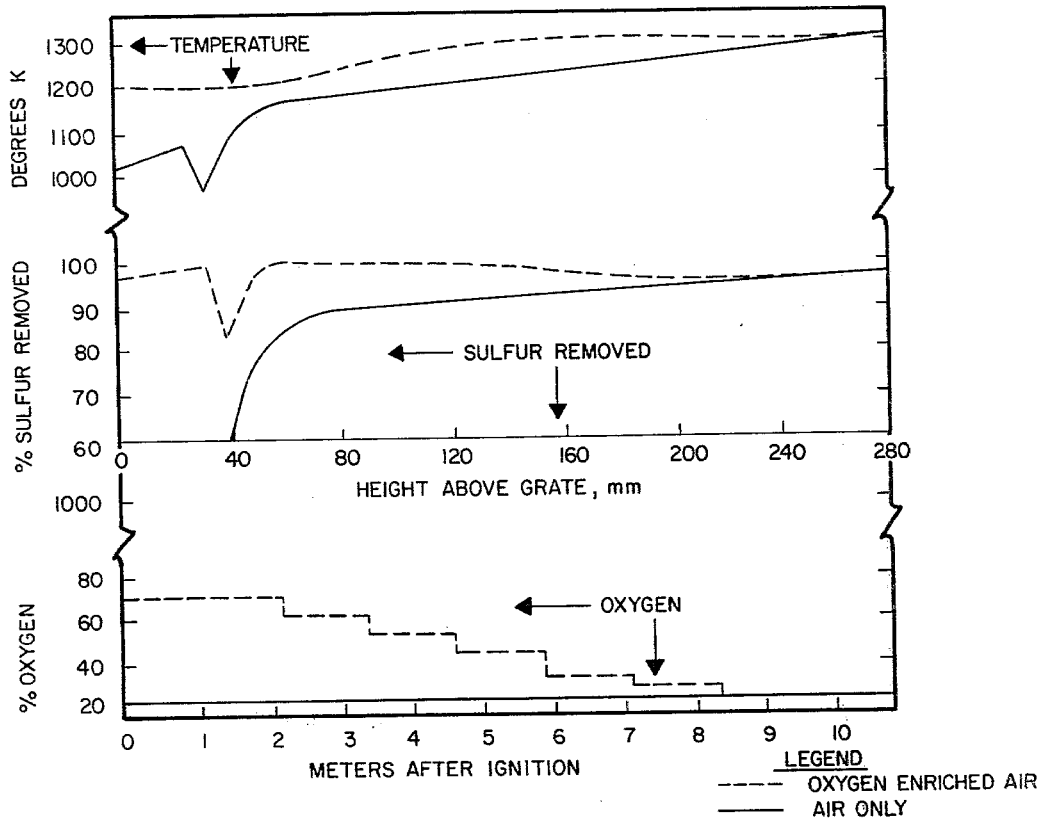
FIG. 3 is a graph comparing the effects of programmed oxygen enrichment wherein overall sulfur elimination is 96.6 percent.

Referring now more particularly to FIG. 3, the results obtained using oxygen-enriched air are compared with a standard run using air only. The bottom curve represents the oxygen content of the wind in both cases plotted against meters after the end of ignition. The run using air only is represented as a straight line at 21 percent and the run using oxygen-enriched air is shown as a stepwise reduction in oxygen content representative of 70, 60, 50, 40, 24, and 21 percent oxygen by volume. The upper two curves are for temperature as a function of height above the grate while the middle two curves represent the removal of sulfur also as a function of height above the grate.

Temperatures for the oxygen-enriched air are uniformly higher than for the standard run and remain just below 1300 K. It was found that oxygen could not be further enriched to increase temperatures at the beginning since the temperatures tended to exceed 1300 K further along the sinter strand. As shown, the sulfur removal was also much better using oxygen-enriched air than for the standard run, averaging 96.6 percent sulfur removal as compared to 84.4 percent when air only was used.

In both sets of upper curves, a sharp dip is noticed in one line of each set of curves. This sharp dip represents the sharp change experienced when the upper, thick layer (about 250 millimeters) of cold, moist feed is spread on top of the ignition layer at a position about one meter downstream of the commencement of the downstream ignition segment (see also FIG. 1).

Figure 4:
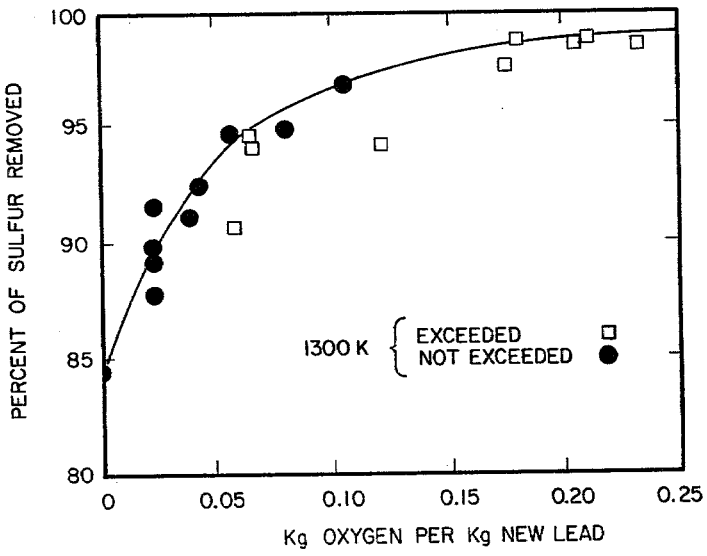
FIG. 4 is a graph comparing the relationship between sulfur elimination and oxygen consumption.

Referring also to FIG. 4, the relationship between sulfur removal and oxygen consumption is shown. The highest desulfurization achieved without exceeding 1300 K was 96.6 percent using the programmed oxygen addition system as shown in FIG. 3. However, it will be noted from FIG. 4 that additional sulfur can be removed although at the expense of a temperature above 1300 K. Advantageously, the combination of programmed oxygen addition, as shown, in combination with selective cooling allowed for a 10 percent increase in concentrate content of the mix. In particular, efforts were directed toward selectively removing heat from those portions of the sinter strand where temperatures tended to be excessive so that the production rate might be increased by using a charge richer in concentrates. However, if grate speed were increased without changing the wind supply to each wind box, the total length available for subsequent cooling (see FIG. 1) would correspondingly decrease. Advantageously, if extra cooling was supplied, it was found possible to still discharge at normal temperature thus increasing productivity without adversely affecting sulfur removal.

It was determined that the additional cooling could be obtained by the use of finely dispersed liquid water added to the current of wind blown through the sinter strand on the grate. A conventional fog nozzle was found to be the appropriate equipment for such an application. Accordingly, it was determined that fog nozzles should be installed in the wing boxes lying below regions where excessive temperatures were known to occur. In passisng through the previously reacted materials, the water particles are evaporated so that the heat content of the wind reaching the hot areas will be lowered by the energy needed to evaporate the water. The overall reaction temperatures will be lowered thereby.

While the precise amount of water addition necessary can be readily calculated, the following considerations may assist in the calculation. For example, with 100 percent of excess air (over and above that theoretically required for oxidation of sulfides), as used in normal operating procedures, saturation at 25° C. would yield three percent steam by volume, or 0.03 mole fraction. Since about 3 moles of air are blown per 100 kg of mix, saturated air would contain about 0.1 moles of steam per 100 kg mix. Accordingly, in the absence of a fog nozzle or other suitable equipment, it would not be possible to add twice this amount, or 0.2 moles of water, and keep it suspended long enough to reach layers of the bed where it can be vaporized.

Referring particularly to Table II, sinter bed cooling using fog nozzles in selected wind boxes is shown. Advantageously, the average sulfur removed was about 96.7 percent. These results indicate that the usage of fog in the amounts suggested will allow a 10 percent increase in production of the sinter machine together with removal of about 96.7 percent of the sulfur initially charged. If a smaller sulfur elimination figure is acceptable, 95 percent of the sulfur can be eliminated by using 0.06 kg oxygen per kg of sulfide sulfur. This is accomplished by replacing oxygen-enriched air, Table II, with ordinary air after 3.6 meters, and using fog cooling in the amount of 0.1 moles per 100 kg mix in the region 8.4 to 12.0 meters after ignition.

TABLE II

SINTER BED COOLING USING FOG NOZZLES IN SELECTED WIND BOXES

Concentrate Level 110% of Normal. Oxygen Usage 0.085 kg/kg Pb in Concentrates

| Distances from Ignition Position (m) | Percent Oxygen in Wind | Fog Added (Mols $H_2O$ Per 100 kg Mix) | Maximum Temperature (Degrees K) | % of Sulfur Removed |
|---|---|---|---|---|
| 0 to 1.2 | 70 | 0 | 1246 | 99.3 |
| 1.2 to 2.4 | 65 | 0 | 1245 | 99.2 |
| 2.4 to 3.6 | 55 | 0 | 1291 | 99.5 |
| 3.6 to 4.8 | 34 | 0 | 1302 | 98.5 |
| 4.8 to 6.0 | 28 | 0 | 1293 | 96.4 |
| 6.0 to 7.2 | 23 | 0 | 1293 | 94.0 |
| 7.2 to 8.4 | 21 | 0.1 | 1292 | 93.8 |
| 8.4 to 9.6 | 21 | 0.2 | 1289 | 94.5 |
| 9.6 to 10.8 | 21 | 0.1 | 1307 | 95.3 |
| 10.8 to 24.0 | 21 | 0 | falling | — |

Average sulfur removed 96.7%

While the amounts of oxygen needed for significant improvements in desulfurization is likely to be minimal with respect to cost per kg of lead in the finished sinter, the overall cost calculated on the basis of tonnages becomes significant. This significant increase in the overall production cost may be at least partially offset by the expedient of increasing the percentage of concentrates in the sinter machine feed as an attractive measure to offset the foregoing increased oxygen costs. Accordingly, increased grate speed coupled with fog cooling and oxygen enrichment not only results in improved desulfurization but also an increased production rate of the particular sinter machine.

In summary, the variables explored indicate that it would be difficult to obtain in excess of 97.5 percent elimination of sulfur with the best results obtained indicating about 96.6 percent elimination by the use of programmed oxygen-enrichment using a normal concentrate level while maintaining the maximum temperature in any part of the sinter bed below 1300 K. The same degree of sulfur elimination was obtained by increasing concentrate level to 110 percent of normal while using programmed oxygen-enrichment in the first 7.2 meters after ignition and fog additions of 0.1 to 0.2 moles per 100 kg mix in the region 7.2 to 10.8 meters after ignition. Correspondingly, if sulfur elimination of 95 percent is adequate, then this also requires oxygen additions of about 0.08 kg oxygen per kg of new lead rather than the 0.11 required for 96.6 percent removal. With concentrate level increased to 110 percent of normal, 95 percent sulfur removal was obtained with oxygen usage of 0.06 kg and a lesser amount of fog cooling.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A process for improving the efficiency of a lead concentrate sintering machine comprising:

laying an initial ignition layer on a moving grate in said sintering machine;

igniting said ignition layer;

laying a mix bed on top of the ignition layer;

enriching combustion air by adding oxygen during the initial stages after the mix bed is laid;

terminating the enriching step at a predetermined distance downstream from ignition; and introducing fog into the combustion air after the enriching step has terminated, the fog maintaining the temperature of the bed below about 1300° K.

2. The process defined in claim 1 wherein the enriching step comprises adding sufficient oxygen to initially increase the oxygen concentration in the combustion air to about 70 percent by volume.

3. The process defined in claim 1 further comprising selectively lowering the amount of oxygen added in the enriching step over a preselected distance downstream from ignition.

4. The process defined in claim 3 wherein the lowering step further comprises decreasing the amount of oxygen added to the combustion air in a stepwise manner.

5. The process defined in claim 1 wherein the introducing step comprises adding finely dispersed liquid water in an amount greater than that required to saturate the combustion air.

6. The process defined in claim 1 wherein the enriching step comprises adding sufficient oxygen to increase the oxygen to a concentration between about 21 percent and about 70 percent by volume.

7. The process defined in claim 1 wherein the enriching step comprises adding sufficient oxygen to increase the oxygen to a concentration between about 30 percent and about 60 percent by volume.

8. The process defined in claim 1 wherein the enriching step comprises adding sufficient oxygen to increase the oxygen to a concentration between about 40 percent and about 50 percent by volume.

9. An improved process for producing lead sinter from a mixture of predetermined proportions of lead concentrate and recycled slag and sinter using a conventional lead concentrate sintering machine comprising:

increasing the proportion of lead concentrate in the mixture fed to the sintering machine;

enriching combustion air by adding oxygen during the initial stages after sinter contact;

decreasing the amount of oxygen enrichment to the combustion air as the mixture passes through the bed;

terminating oxygen enrichment of the combustion air at a first predetermined distance downstream of initial sinter contact; and adding water to the combustion air at a second predetermined distance downstream of the initial sinter contact, the water being added in the form of finely divided liquid water.

* * * * *